US006391833B1

(12) United States Patent
Ilmain et al.

(10) Patent No.: US 6,391,833 B1
(45) **Date of Patent: *May 21, 2002**

(54) LOW SULFUR LUBRICANT COMPOSITION FOR TWO-STROKE ENGINES

(75) Inventors: Frank Ilmain, Berkshire (GB); Sumanth Addagarla, Richmond, CA (US); Jacques Cazin, Saint Martin du Manoir (FR)

(73) Assignee: Chevron Chemical S.A., Neuilly sur Se Villiers (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/295,707

(22) Filed: Apr. 21, 1999

(30) Foreign Application Priority Data

May 15, 1998 (EP) ..... 98401192

(51) Int. Cl.[7] ..... C10M 141/02; C10M 141/12
(52) U.S. Cl. ..... 508/518; 508/364; 508/379
(58) Field of Search ..... 508/578, 379, 508/364

(56) References Cited

U.S. PATENT DOCUMENTS

| | | | | |
|---|---|---|---|---|
| 3,004,837 | A | 10/1961 | Riemenschneider | 44/58 |
| 3,085,975 | A | 4/1963 | Jennings | 210/58 |
| 3,753,905 | A | 8/1973 | Souillard et al. | 252/33.4 |
| 4,663,063 | A | 5/1987 | Davis | 252/51.5 R |
| 4,719,023 | A | 1/1988 | MacPhail et al. | 252/39 |
| 5,458,807 | A | 10/1995 | Tamoto | 252/32.7 E |
| 5,498,353 | A | 3/1996 | Lin et al. | 508/518 |
| 5,516,444 | A | 5/1996 | Gaines et al. | 252/51.5 A |
| 5,672,572 | A | 9/1997 | Arai et al. | 508/518 |
| 5,688,751 | A | 11/1997 | Cleveland et al. | 508/518 |
| 5,744,430 | A | 4/1998 | Inoue et al. | 508/295 |
| 5,895,777 | A | 4/1999 | Ueda et al. | 508/518 |

FOREIGN PATENT DOCUMENTS

| | | | |
|---|---|---|---|
| EP | 6751912 | 4/1995 | C10L/1/18 |
| SU | 749882 B | 7/1980 | |

OTHER PUBLICATIONS

Smalheer et al; "Lubricant Additives", 1967.

*Primary Examiner*—Jacquline V. Howard
(74) *Attorney, Agent, or Firm*—Richard J. Sheridan; Linda A. Stokley; Martin C. Fallon

(57) ABSTRACT

A low sulfur detergency additive suitable for lubricant composition used in air-cooled two-stroke cycle engines having an unsulfurized alkaline earth alkylsalicylate and optionally a molybdenum compound.

15 Claims, No Drawings

LOW SULFUR LUBRICANT COMPOSITION FOR TWO-STROKE ENGINES

The present invention relates to low sulfur lubricant compositions having excellent detergency properties suitable for use in two-stroke engines, low sulfur detergency additives useful in those low sulfur lubricant compositions, fuels containing those low sulfur detergency additives, and concentrates of those low sulfur detergency additives.

BACKGROUND OF THE INVENTION

Over the past several decades the use of spark ignited two-stroke internal combustion engines has steadily increased. They are presently found in power lawn mowers and other power operated garden equipment, power chain saws, pumps, electrical generators, marine outboard engines, snowmobiles, motorcycles and the like.

The increasing use of two-stroke cycle engines, coupled with increasing severity of the conditions in which they have operated, has led to an increased demand for oils to adequately lubricate such engines. Among the problems associated with two-stroke cycle engines is piston lubricity, scuffing or scoring. Lubricating oils often contain sulfur, a key element in anti-wear performance. Much of the sulfur contribution comes from the detergent-dispersant additives used in the lubricating oils. However, the level of sulfur has become environmentally sensitive and a move toward lower sulfur levels is increasing. One of the drivers has been the presence of low sulfur base oils in some parts of the world. Low sulfur lubricating oil additive packages are not common.

The unique problems and techniques associated with the lubrication of two-stroke cycle engines has led to the recognition by those skilled in the art of two-stroke cycle engine lubricants as a distinct lubricant type. See, for example, U.S. Pat. Nos. 3,085,975; 3,004,837; and 3,753,905.

U.S. Pat. No. 4,663,063 discloses a functional fluid for a two-cycle engine having base oil and a combination of an alkylated phenol and a polyalkylene polyamine. That patent discloses that metal thiocarbamates are useful as extreme pressure agents.

U.S. Pat. No. 5,516,444 discloses a functional fluid for a two-cycle engine having base oil and an acylated nitrogen-containing compound having an oil soluble olefinic substituent and at least one ashless detergent/dispersant. That patent discloses that molybdenum- and molybdenum/sulfur-containing compounds are some of the anti-wear and lubricity agents useful in that invention.

U.S. Pat. No. 5,458,807 discloses a lubricating oil composition useful in automobiles and various industrial internal combustion engines. That lubricating oil composition has base oil, a boron compound derivative of alkenylsuccinimide, an alkaline earth metal salt of salicylic acid, and a molybdenum compound.

U.S. Pat. No. 5,688,751 discloses alkali metal salicylate salts as lubricant additives for two-cycle engines.

SUMMARY OF THE INVENTION

The present invention provides a low sulfur (<0.2%) detergency additive especially useful in lubricant composition used in air-cooled two-stroke cycle engines. That low sulfur detergency additive comprises an unsulfurized alkaline earth alkylsalicylate and optionally a molybdenum compound. Alkylphenol and alkaline earth alkylphenate can also be present in the low sulfur detergency additive.

Preferably, the unsulfurized alkaline earth alkylsalicylate is calcium alkylsalicylate wherein the mole ratio of single aromatic-ring alkylsalicylate to double aromatic-ring alkylsalicylate in said unsulfurized alkaline earth alkylsalicylate is at least 8:1.

The present invention also provides a low sulfur lubricant composition suitable for air-cooled two-stroke cycle engines. This lubricant composition has a major amount of low sulfur oil of lubricating viscosity and a minor amount of the low sulfur detergency additive. Preferably, the lubricant composition also has a minor amount of a non-aromatic solvent, a minor amount of a polyisobutene, and/or a minor amount of an ashless dispersant. The lubricating oil composition can be produced by blending together a major amount of the oil of lubricating viscosity, a minor amount of low sulfur detergency additive, and preferably minor amounts other additives, such as non-aromatic solvent, polyisobutene, and an ashless dispersant. The low sulfur lubricant composition can be used to lubricate an air-cooled two-stroke cycle engine by supplying the lubricant composition to the engine crankcase and operating the engine or by supplying the lubricant composition to the fuel and operating the engine.

The present invention also provides an additive concentrate suitable for mixing with base oil to provide lubricating oils which may be used to lubricate air-cooled two-stroke cycle engines. This additive has a minor amount of an organic diluent, plus from 20 to 80% of the low sulfur detergency and preferably a non-aromatic solvent, a polyisobutene, and/or an ashless dispersant.

DETAILED DESCRIPTION OF THE INVENTION

In its broadest aspect, the present invention involves a low sulfur detergency additive having excellent detergency properties when used in a low sulfur lubricant composition for air-cooled two-stroke engines. The low sulfur detergency additive comprises an unsulfurized alkaline earth alkylsalicylate and optionally a molybdenum compound.

Prior to discussing the invention in further detail, the following terms will be defined:

Definitions

As used herein the following terms have the following meanings unless expressly stated to the contrary:

The term "low sulfur" means less than 0.2% sulfur, including no sulfur.

The term "alkylphenol" means a phenol group having one or more alkyl substituents; at least one of which has a sufficient number of carbon atoms to impart oil solubility to the phenol.

The term "alkaline earth metal" means calcium, barium, magnesium, and strontium.

The term "alkaline earth alkylphenate" means an alkaline earth metal salt of an alkylphenol.

The term "alkaline earth alkylsalicylate" means an alkaline earth metal salt of an alkyl salicylic acid.

The term "alkaline earth single aromatic-ring alkylsalicylate" means an alkaline earth alkylsalicylate having only one alkyl salicylic anion per each alkaline earth metal base cation. Thus one mole of alkaline earth single aromatic-ring alkylsalicylate will contain one mole of aromatic ring and one mole of alkaline earth base cation. Thus, a calcium single aromatic-ring alkylsalicylate would have one aromatic ring for each calcium ion.

The term "alkaline earth double aromatic-ring alkylsalicylate" means an alkaline earth alkylsalicylate having two alkyl salicylic anions per each alkaline earth metal base cation. Thus one mole of alkaline earth double aromatic-ring alkylsalicylate will contain two mole of aromatic rings and one mole of alkaline earth base cation. Thus, a calcium double aromatic-ring alkylsalicylate would have two aromatic rings for each calcium ion.

The term "Base Number" or "BN" refers to the amount of base equivalent to milligrams of KOH in one gram of sample. Thus, higher BN numbers reflect more alkaline products, and therefore a greater alkalinity reserve. The BN of a sample can be determined by ASTM Test No. D2896 or any other equivalent procedure.

Unless otherwise specified, all percentages are in weight percent and all molecular weights are number average molecular weights.

Base Oil Of Lubricating Viscosity

The present invention relates to lubricating oil compositions and to lubricant fuels suitable for use in two-stroke engines. The lubricating compositions useful for two-stroke cycle engines will compose a major amount by weight of at least one base oil of lubricating viscosity and a minor amount of the present additives, sufficient to control piston ring sticking, reduce rust formation, and promote general engine cleanliness.

The lubricating compositions and methods of this invention employ oils of lubricating viscosity, including natural or synthetic lubricating oils and mixtures thereof. While conventional base oils might have 0.4% sulfur, the base oils of the present invention must have less than 0.2% sulfur, preferably less than 0.1% sulfur. Natural oils include, for example, animal oils, vegetable oils, mineral oils, solvent or acid treated mineral oils, and oils derived from coal or shale. Synthetic lubricating oils include, for example, hydrocarbon oils, halo substituted hydrocarbon oils, alkylene oxide polymers, esters of mono- and dicarboxylic acids and polyols, esters of phosphorus containing acids, polymeric tetrahydrofurans, and silicon based oils. Since synthetic base oils typically do not contain sulfur, they can be used to make very low sulfur formulation.

Low Sulfur Detergency Additive

The low sulfur detergency additive of the present invention comprises an unsulfurized alkaline earth alkylsalicylate and optionally a molybdenum compound.

Unsulfurized Alkaline Earth Alkylsalicylate

Sulfurized and unsulfurized alkaline earth alkylsalicylate are well known. Such alkylsalicylates are usually double aromatic-ring alkylsalicylates, but single aromatic-ring alkylsalicylates are also known. Preferably, the unsulfurized alkaline earth alkylsalicylate is calcium alkylsalicylate.

Preferred Process for Producing Unsulfurized Alkaline Earth Alkylsalicylates One preferred process for producing unsulfurized alkaline earth alkylsalicylates can be characterize by its unique composition, with much more alkylphenol and alkaline earth single aromatic-ring alkylsalicylate than produced by other routes. That reaction product has the following composition:

(a) from 40% to 60% alkylphenol, (b) from 10% to 40% alkaline earth alkylphenate, and (c) from 20% to 40% alkaline earth single aromatic-ring alkylsalicylate.

Unlike other processes for producing alkaline earth alkylsalicylates, this reaction product can be characterized by having only minor amounts of an alkaline earth double aromatic-ring alkylsalicylates. The mole ratio of single aromatic-ring alkylsalicylate to double aromatic-ring alkylsalicylate is at least 8:1.

Neutralization Step

In the first step, alkylphenols are neutralized using an alkaline earth base in the presence of at least one $C_1$ to $C_4$ carboxylic acid. This reaction is carried out in the absence of alkali base, and in the absence of dialcohol or monoalcohol.

The alkylphenols contain up to 85% of linear alkylphenol (preferably at least 35% linear alkylphenol) in mixture with at least 15% of branched alkylphenol. Preferably, the linear alkyl radical contains 12 to 40 carbon atoms, more preferably 18 to 30 carbon atoms. The branched alkyl radical contains at least nine carbon atoms, preferably 9 to 24 carbon atoms, more preferably 10 to 15 carbon atoms.

The use of an alkylphenol containing at least 35% of long linear alkylphenol (from 18 to 30 carbon atoms) is particularly attractive because a long linear alkyl chain promotes the compatibility and solubility of the additives in lubricating oils. However, the presence of relatively heavy linear alkyl radicals in the alkylphenols makes the latter less reactive than branched alkylphenols, hence the need to use harsher reaction conditions to bring about their neutralization by an alkaline earth base.

Branched alkylphenols can be obtained by reaction of phenol with a branched olefin, generally originating from propylene. They consist of a mixture of monosubstituted isomers, the great majority of the substituents being in the para position, very few being in the ortho position, and hardly any in the meta position. That makes them relatively reactive towards an alkaline earth base, since the phenol function is practically devoid of steric hindrance.

On the other hand, linear alkylphenols can be obtained by reaction of phenol with a linear olefin, generally originating from ethylene. They consist of a mixture of monosubstituted isomers in which the proportion of linear alkyl substituents in the ortho, para, and meta positions is much more uniformly distributed. This makes them much less reactive towards an alkaline earth base since the phenol function is much less accessible due to considerable steric hindrance, due to the presence of closer and generally heavier alkyl substituents.

The alkaline earth bases that can be used for carrying out this step include the oxides or hydroxides of calcium, magnesium, barium, or strontium, and particularly of calcium oxide, calcium hydroxide, magnesium oxide, and mixtures thereof. In one embodiment, slaked lime (calcium hydroxide) is preferred.

The $C_1$ to $C_4$ carboxylic acids used in this step include formic, acetic, propionic and butyric acid, and may be used alone or in mixture. Preferably, a mixture of acids is used, most preferably a formic acid/acetic acid mixture. The molar ratio of formic acid/acetic acid should be from 0.2:1 to 100:1, preferably between 0.5:1 and 4:1, and most preferably 1:1. The carboxylic acids act as transfer agents, assisting the transfer of the alkaline earth bases from a mineral reagent to an organic reagent.

The neutralization operation is carried out at a temperature of at least 200° C., preferably at least 215° C., and, more preferably, at least 240° C. The pressure is reduced gradually below atmospheric in order to distill off the water of reaction. Accordingly the neutralization should be conducted in the absence of any solvent that may form an azeotrope with water. Preferably, the pressure is reduced to no more than 7,000 Pa (70 mbars).

The quantities of reagents used should correspond to the following molar ratios:

(1) alkaline earth base/alkylphenol of 0.2:1 to 0.7:1, preferably 0.3:1 to 0.5:1; and (2) carboxylic acid/alkylphenol of 0.01:1 to 0.5:1, preferably from 0.03:1 to 0.15:1.

Preferably, at the end of this neutralization step the alkylphenate obtained is kept for a period not exceeding fifteen hours at a temperature of at least 215° C. and at an absolute pressure of between 5,000 and 105 Pa (between 0.05 and 1.0 bar). More preferably, at the end of this neutralization step the alkylphenate obtained is kept for between two and six hours at an absolute pressure of between 10,000 and 20,000 Pa (between 0.1 and 0.2 bar).

By providing that operations are carried out at a sufficiently high temperature and that the pressure in the reactor is reduced gradually below atmospheric, the neutralization reaction is carried out without the need to add a solvent that forms an azeotrope with the water formed during this reaction.

Carboxylation Step

The carboxylation step is conducted by simply bubbling carbon dioxide into the reaction medium originating from the preceding neutralization step and is continued until at least 20 mole % of the alkylphenate to alkylsalicylate (measured as salicylic acid by potentiometric determination). It must take place under pressure in order to avoid any decarboxylation of the alkylsalicylate that forms.

Preferably, at least 22 mole % of the starting alkylphenols is converted to alkylsalicylate using carbon dioxide at a temperature of between 180° and 240° C., under a pressure within the range of from above atmospheric pressure to 15×105 Pa (15 bars) for a period of one to eight hours.

According to one variant, at least 25 mole % of the starting alkylphenols is converted to alkylsalicylate using carbon dioxide at a temperature equal to or greater than 200° C. under a pressure of 4×105 Pa (4 bars).

Filtration Step

The purpose of the filtration step is to remove sediments, and particularly crystalline calcium carbonate, which might have been formed during the preceding steps, and which may cause plugging of filters installed in lubricating oil circuits.

Molybdenum Compounds

Suitable molybdenum compounds that can be used in the invention include, for example, molybdenum dithiophosphate (MoDTP) and molybdenum dithiocarbamate (MoDTC). This MoDTP includes molybdenum dialkyl (or diaryl) dithiophosphate such as molybdenum diisopropyldithiophosphate, molybdenum di-(2-ethylhexyl) dithiophosphate and molybdenum di-(nonylphenyl) dithiophosphate. MoDTC includes molybdenum dialkyldithiocarbamate such as molybdenum dibutyldithiocarbamate, molybdenum di-(2-ethylhexyl) dithiocarbamate and molybdenum dilauryldithiocarbamate. Other molybdenum compounds include molybdenum oxydisulfides and Molyvane® 855 (a non-sulfur, non-phosphorus molybdenum compound sold by the R. T. Vanderbilt Company).

The amount of sulfur-containing molybdenum compounds (such as molybdenum dithiophosphates, molybdenum dithiocarbamates, molybdenum oxydisulfides) should be kept low so that the sulfur in the lubricating oil composition will be less than 0.2%.

Other Additive Components

Non-aromatic Solvent

The compositions of the present invention may optionally contain a minor amount of a non-aromatic solvent. The solvent is used just to adjust the viscosity of the finished oil. It should be non-aromatic in order to minimize the smoke at the exhausts. Suitable non-aromatic solvents include dearomatized aliphatic distillate in the 200°–240° C. range.

Polyisobutylene

The compositions of the present invention may optionally contain up to 10% of a polyisobutylene having a molecular weight from 350 to 2000, preferably about 950. This polyisobutylene is present in an amount up to 10%, preferably up to 7%, more preferably 5%, more preferably up to 3%. The polyisobutylene acts to improve lubricity and anti-scuff activity of the lubricant.

Ashless Dispersant

A wide variety of ashless detergent/dispersants can be used in this invention. Suitable detergent/dispersants are basic nitrogen compounds that have a basic nitrogen content as measured by ASTM D-664 or D-2896. They are preferably oil-soluble. Typical of such compositions are succinimides, carboxylic acid amides, hydrocarbyl monoamines, hydrocarbyl polyamines, Mannich bases, phosphoramides, phosphonamides, dispersant viscosity index improvers, and mixtures thereof. These basic nitrogen-containing compounds are described below. Any of the nitrogen-containing compositions may be after-treated using procedures well known in the art so long as the compositions continue to contain basic nitrogen. Post-treatment may be accomplished by contacting the basic nitrogen-containing compound with the after-treating compound(s) concurrently or in any sequence. Suitable post-treating compounds include urea, thiourea, carbon disulfide, aldehydes, ketones, carboxylic acids, hydrocarbon-substituted succinic anhydrides, nitriles, epoxides, boron compounds, organic phosphorus compounds, inorganic phosphorus compounds (such as $H_3PO_3$, $H_3PO_4$, etc.) or the like, and mixtures thereof. These after-treatments are particularly applicable to succinimides and Mannich base compositions.

The mono- and polysuccinimides that can be used as an ashless dispersant in this invention are disclosed in numerous references and are well known in the art. Certain fundamental types of succinimides and the related materials encompassed by the term of art "succinimide" are described in U.S. Pat. Nos. 3,219,666; 3,172,892; and 3,272,746, the disclosures of which are hereby incorporated by reference. The term "succinimide" is understood in the art to include many of the amide, imide, and amidine species which may also be formed. The predominant product however is a succinimide and this term has been generally accepted as meaning the product of a reaction of an alkenyl substituted succinic acid or anhydride with a nitrogen-containing compound. Preferred succinimides, because of their commercial availability, are those succinimides prepared from a hydrocarbyl succinic anhydride, wherein the hydrocarbyl group contains from about 60 to about 350 carbon atoms, and an ethylene amine, said ethylene amines being especially characterized by ethylene diamine, diethylene triamine, triethylene tetramine, and tetraethylene pentamine. Particularly preferred are those succinimides prepared from polyisobutenyl succinic anhydride of about 70 to 128 carbon atoms and tetraethylene pentamine or the so-called "polyamine bottoms" resulting from polyethyleneamine synthesis. These "polyamine bottoms" predominately contain pentaethylene hexamine and tetraethylene pentamine and a lesser amount of lighter ethylene polyamines and cyclic condensation products containing piperazine rings.

Also included within the term "succinimide" are the cooligomers of a hydrocarbyl succinic acid or anhydride and a poly secondary amine containing at least one tertiary amino nitrogen in addition to two or more secondary amino groups. Ordinarily this composition has between 1,500 and 50,000 number average molecular weight (Mn). A typical compound would be that prepared by reacting polyisobutenyl succinic anhydride and ethylene dipiperazine Other Additives Other additives that are particularly useful in the present invention are imidazolines, such as 2-methylimidazoline, and polyalkyl amines, such as disclosed in U.S. Pat. No. 4,713,188, which is incorporated by reference for all purposes.

The compositions of the present invention may also optionally contain up to 10% by weight of a functionalized polyisobutylene having a number average molecular weight from 400 to 2500, preferably about 1300. The functional group for the olefin is typically amine based. This functionalized polyisobutylene is present in an amount up to 15% by weight, preferably up to 10%, more preferably about 5%, by weight. The functionalized polyisobutylene is therefore, a reaction product of the olefin and olefin polymers with amines (mono- or- polyamines). The functionalized polyisobutylene provides superior detergency performance in two-stroke cycle engines.

The invention also contemplates the use of other additives in combination with the compositions of this invention. Such additives include, for example, corrosion and oxidation inhibiting agents, pour point depressing agents, extreme pressure agents, antiwear agents, coke stabilizers and anti foam agents.

Pour point depressants are a particularly useful type of additive often included in the lubricating oils described herein. The use of such pour point depressants in oil based compositions to improve low temperature properties of oil based compositions is well known in the art. See, for example, page 8 of "Lubricant Additives," by C. V. Smalheer and R. Kennedy Smith (Lezius Hiles Co. publishers, Cleveland, Ohio, 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715.

Anti foam agents are used to reduce or prevent the formation of stable foam. Typical anti foam agents include silicones or organic polymers. Additional anti foam compositions are described in "Foam Control Agents," by Henty T. Kerner (Noyes Data Corporation, 1976), pages 125–162.

Lubricating Oil Composition

The low sulfur detergency additive of this invention is useful for imparting greater detergency to an engine lubricating oil composition. Such a lubricating oil composition comprises a major part of base oil of lubricating viscosity and an effective minor amount of the low sulfur detergency additive. That lubricant composition has less than 0.2% sulfur.

In one embodiment, the lubricating oil composition would contain (a) a major part of a base oil of lubricating viscosity;

(b) from 5 to 10 mM of an unsulfurized alkaline earth alkylsalicylate;

(c) from 0.1% to 2% of a molybdenum compound; and optionally, at least one of the following:

(d) a minor amount of a non-aromatic solvent;

(e) a minor amount of a polyisobutene; and (f) a minor amount of an ashless dispersant.

The lubricating oil composition of the present invention is useful in a method of lubricating an air-cooled two-stroke cycle engine. In that method, the lubricant composition is supplied to the crankcase of the engine or to the fuel added to the engine, and the engine is operated.

In a further embodiment, an engine lubricating oil composition is produced by blending a mixture of the above components. The lubricating oil composition produced by that method might have a slightly different composition than the initial mixture, because the components may interact.

The components can be blended in any order and can be blended as combinations of components. For instance, the alkylsalicylate and the molybdenum compound can be blended together prior to being blended with the other components of the mixture. Likewise, the non-aromatic solvent, polyisobutene, and/or ashless dispersant can be blended with the alkylsalicylate and the molybdenum compound (or the mixture of the alkylsalicylate and the molybdenum compound) prior to being blended with the base oil.

Additive Concentrates

Additive concentrates are also included within the scope of this invention. The concentrates of this invention comprise the compounds or compound mixtures of the present invention, preferably with at least one other additive, as disclosed above. The concentrates contain sufficient organic diluent to make them easy to handle during shipping and storage.

Preferably, the additive concentrate would comprise from 20 to 80% of an organic diluent, the low sulfur detergency additive of the present invention and minor amounts of non-aromatic solvent, polyisobutene, and/or ashless dispersant. Suitable organic diluents that can be used include mineral oil or synthetic oils, as described above in the section entitled "Base Oil of Lubricating Viscosity."

Fuel Oils

As is well known to those skilled in the art, two-cycle engine lubricating oils are often added directly to the fuel to form a mixture of oil and fuel which is then introduced into the engine cylinder. Such lubricant-fuel oil mixtures are within the scope of this invention. Such lubricant-fuel blends generally contain per 1 part of oil about 15–250 parts fuel, typically they contain 1 part oil to about 25–100 parts fuel.

In some two-cycle engines, the lubricating oil can be directly injected into the combustion chamber along with the fuel or into the fuel just prior to the fuel entering the combustion chamber. The two-cycle lubricants of this invention can be used in this type of engine.

The fuels used in two-cycle engines are well known to those skilled in the art and usually contain a major portion of a normally liquid fuel such as hydrocarbonaceous petroleum distillate fuel (e.g., motor gasoline as defined by ASTM Specification D-439-73). Such fuels can also contain non-hydrocarbonaceous materials such as alcohols, ethers, organo-nitro compounds and the like (e.g., methanol, ethanol, diethyl ether, methyl ethyl ether, nitromethane). Also within the scope of this invention are liquid fuels derived from vegetable or mineral sources such as corn, alfalfa, shale and coal. Examples of such fuel mixtures are combinations of gasoline and ethanol, diesel fuels, diesel fuels and ether, gasoline and nitromethane, etc. Particularly preferred is gasoline, that is, a mixture of hydrocarbons having as ASTM boiling point of 60° C. at the 10% distillation point to about 205° C. at the 90% distillation point.

EXAMPLES

The invention will be further illustrated by following examples, which set forth particularly advantageous method embodiments. While the Examples are provided to illustrate the present invention, they are not intended to limit it.

In the following examples, a reference formulation (Comparative Example C) having a phenate/sulfonate was modified by replacing the phenate/sulfonate with an unsulfurized alkaline earth alkylsalicylate and/or a molybdenum compound. The reference formulation had 5.85% succinimide dispersants, but the other examples and comparative examples all had 4.75% succinimide dispersants. The results are shown in Table I.

The detergency index (CEC 3 Hour "GD" Detergency Test CEC L-079-X-94) was measured for each example. The detergency index is a measure of the cleanliness of the engine during the test. In the basic measurement, the cleanliness of the candidate oil is compared to that of reference oil on a percentage basis. The reference oil is given a standard index of 100 for each test. Specifically, there are about eight engine areas of performance that are given a cleanliness rating with different weighting factors. These are then summed up to give an overall rating. The rating is then normalized against the reference oil and given an index. This index is the reported number and being used to compare the overall performance of the oil.

Example I

The formulation contained 7 mM of unsulfurized alkaline earth alkylsalicylate and 0.25% Molyvan® 855. The formulation contained 4.75% succinimide dispersants.

Example II

The formulation contained 7 mM of unsulfurized alkaline earth alkylsalicylate and 0.25% molybdenum oxydisulfide. The formulation contained 4.75% succinimide dispersants.

Example III

The formulation contained 7 mM of unsulfurized alkaline earth alkylsalicylate but no molybdenum compound. The formulation contained 4.75% succinimide dispersants.

Comparative Example A

The formulation contained 0.25% Molyvane® 855, but no unsulfurized alkaline earth alkylsalicylate. The formulation contained 4.75% succinimide dispersants.

Comparative Example B

The formulation contained neither unsulfurized alkaline earth alkylsalicylate nor molybdenum compound. This was the reference formulation, with 5.85% succinimide dispersants and 12 mM phenate/sulfonate.

TABLE I

| Example | I | II | III | A | B |
|---|---|---|---|---|---|
| Dispersant | 4.75% | 4.75% | 4.75% | 4.75% | 5.85% |
| Salicylate | 7 mM | 7 mM | 7 mM | — | — |
| Mo Compound | 0.25% | 0.25% | — | 0.25% | — |
| Detergency Index | 154 | 143 | 141 | 135 | 126 |
| ppm S | 1210 | 1300 | 1220 | 1210 | 1730 |

Notice that the above examples show that the combination of the alkylsalicylate and molybdenum compound gave higher detergency than either component alone. Also notice that the examples show that alkylsalicylate alone or in combination with the molybdenum compound gave higher detergency at a lower sulfur level than conventional formulations having conventional phenate/sulfonates.

While the present invention has been described with reference to specific embodiments, this application is intended to cover those various changes and substitutions that may be made by those skilled in the art without departing from the spirit and scope of the appended claims.

What is claimed is:

1. A method of lubricating an air-cooled two stroke cycle engine, comprising supplying a detergency additive to the crankcase of said engine and operating said engine, wherein the detergency additive comprises an unsulfurized alkaline earth alkylsalicylate and a molybdenum compound.

2. A method of lubricating an air-cooled two stroke cycle engine, comprising supplying a detergency additive to the crankcase of said engine and operating said engine, wherein the detergency additive comprises the detergency additive of claim 1, wherein said unsulfurized alkaline earth alkylsalicylate is calcium alkylsalicylate.

3. A method of lubricating an air-cooled two stroke cycle engine comprising supplying a detergency additive to the crankcase of said engine and operating said engine, wherein said detergency additive comprises the detergency additive of claim 1 and further comprises alkylphenol and alkaline earth alkylphenate, and wherein the mole ratio of single aromatic-ring alkylsalicylate to double aromatic-ring alkylsalicylate in said unsulfurized alkaline earth alkylsalicylate is at least 8:1.

4. A method of lubricating an air-cooled two stroke cycle engine comprising supplying a lubricant composition to the crankcase of said engine and operating said engine, wherein said lubricant composition comprises:

(a) a major amount of at least one base oil of lubricating viscosity having less than 0.2% sulfur, and (b) a minor amount of a detergency additive according to claim 1, wherein the lubricant composition has less than 0.2% sulfur.

5. A method of lubricating an air-cooled two stroke cycle engine comprising supplying a lubricant composition to the crankcase of said engine and operating said engine, wherein the lubricant composition comprises at least one of the following:

(a) a minor amount of a non-aromatic solvent;

(b) a minor amount of a polyisobutene; and (c) a minor amount of an ashless dispersant.

6. A method of lubricating an air-cooled two stroke cycle engine comprising supplying a lubricating oil composition to the crankcase of said engine and operating said engine, wherein said lubricating oil composition comprises:

(a) a major amount of at least one base oil of lubricating viscosity having less than 0.2% sulfur;

(b) a minor amount of a detergency additive according to claim 1; and (c) at least one of the following:

(1) a minor amount of a non-aromatic solvent;

(2) a minor amount of a polyisobutene, and (3) a minor amount of an ashless dispersant;

wherein the lubricanting composition has less than 0.2% sulfur.

7. A method of lubricating an air-cooled two-stroke cycle engine, comprising supplying a lubricant composition having less than 0.2% sulfur to the crankcase of said engine and operating said engine, wherein said lubricant composition comprises: a major amount of at least one base oil of lubricating viscosity having less than 0.2% sulfur; and a minor amount of a detergency additive comprising an unsulturized alkaline earth alkylsalicylate and a molybdenum compound.

8. A method of lubricating an air-cooled two-stroke cycle engine, comprising supplying a lubricant composition to the fuel of said engine and operating said engine wherein said lubricant composition has less than 0.2% sulfur and comprises:

(a) a major amount of at least one base oil of lubricating viscosity having less than 0.2% sulfur; and (b) a minor amount of a detergency additive comprising an unsulfurized alkaline earth alkylsalicylate and a molybdenum compound.

9. A method of lubricating an air-cooled two stroke cycle engine comprising supplying a detergency additive to the fuel of said engine and operating said engine, wherein said detergency additive comprises an unsulfurized alkaline earth alkylsalicylate and a molybdenum compound.

10. The method of claim 7, wherein the unsulfurized alkaline earth alkylsalicylate is unsulfurized calcium alkylsalicylate.

11. A method of lubricating an air-cooled two stroke cycle engine comprising supplying a detergency additive to the fuel of said engine and operating said engine, wherein said detergency additive comprises an unsulfurized alkaline earth alkylsalicylate, a molybdenum compound, alkylphenol and alkaline earth alkylphenate, and wherein the mole ratio of single aromatic-ring alkylsalicylate to double aromatic-ring alkylsalicylate in said unsulfurized alkaline earth alkylsalicylate is at least 8:1.

12. A method of lubricating an air-cooled two stroke cycle engine comprising supplying a lubricant composition to the fuel of said engine and operating said engine, wherein said lubricant composition comprises:

(a) a major amount of at least one base oil of lubricating viscosity having less than 0.2% sulfur; and (b) a minor amount of a detergency additive comprising an unsulfurized alkaline earth alkylsalicylate and a molybdenum compound; and wherein the lubricant composition has less than 0.2% sulfur.

13. A method of lubricating an air-cooled two stroke cycle engine comprising supplying a lubricant composition to the fuel of said engine and operating said engine, wherein said lubricant composition comprises comprises the detergency additive of claim 12 and at least one of the following:

(a) a minor amount of a non-aromatic solvent;

(b) a minor amount of a polyisobutene; and (c) a minor amount of an ashless dispersant.

14. A method of lubricating an air-cooled two stroke cycle engine comprising supplying a lubricant composition to the fuel of said engine and operating said engine, wherein said lubricant composition comprises:

(a) a major amount of at least one base oil of lubricating viscosity having less than 0.2% sulfur;

(b) a minor amount of a detergency additive comprising an unsulfurized alkaline earth alkylsalicylate and a molybdenum compound; and (c) at least one of the following:

(1) a minor amount of a non-aromatic solvent;

(2) a minor amount of a polyisobutene; and (3) a minor amount of an ashless dispersant;

wherein the lubricant composition has less than 0.2% sulfur.

15. A method of lubricating an air-cooled two stroke cycle engine comprising supplying an additive concentrate to the fuel of said engine and operating said engine, wherein said additive concentrate comprises:

(a) from 20 to 80% of an organic diluent, (b) the detergency additive according to claim 1, and (c) optionally, at least one of the following:

(1) a minor amount of a non-aromatic solvent;

(2) a minor amount of a polyisobutene; and (3) a minor amount of an ashless dispersant.

* * * * *